US007001310B1

(12) United States Patent
Brice

(10) Patent No.: US 7,001,310 B1
(45) Date of Patent: Feb. 21, 2006

(54) ADJUSTABLE WEIGHT EXERCISE DEVICE

(76) Inventor: John P. Brice, 11549 Laurel Oak Rd., Victorville, CA (US) 92392

( * ) Notice: Subject to any disclaimer, the term of this patent is extended or adjusted under 35 U.S.C. 154(b) by 242 days.

(21) Appl. No.: 10/271,151

(22) Filed: Oct. 15, 2002

Related U.S. Application Data

(60) Provisional application No. 60/329,130, filed on Oct. 15, 2001.

(51) Int. Cl.
*A63B 21/00* (2006.01)

(52) U.S. Cl. ..... 482/10; 106/108

(58) Field of Classification Search ..... 482/104–109, 482/148
See application file for complete search history.

(56) References Cited

U.S. PATENT DOCUMENTS 5,090,693 A * 2/1992 Liang ..... 482/108
5,464,379 A * 11/1995 Zarecky ..... 482/108
5,628,716 A * 5/1997 Brice ..... 482/106
6,736,755 B1 * 5/2004 Kato ..... 482/106

OTHER PUBLICATIONS

Atlantic fitness products Nov. 1, 1985 170 Penrod ct Glen Burnie,Md 21061 p. 40 Atlas Barbell Rack.*

* cited by examiner

*Primary Examiner*—Jerome W. Donnelly
(74) *Attorney, Agent, or Firm*—Don Finkelstein

(57) ABSTRACT

This invention is an adjustable weight exercise device such as a bar bell or a dumbbell in which a handle is provided with fixed weights permanently coupled to each end of the handle and a collar is provided having a first portion for detachable threading engagement with the fixed weights and the collar has a second portion with external threads for detachable threading engagement with a threaded aperture in add on weights.

15 Claims, 5 Drawing Sheets

36
28
30
28a
26
24
29
29
24
28
26
30
32

29
36
28
26
24
38
34
32
32a
30
38
36

ADJUSTABLE WEIGHT EXERCISE DEVICE

This application claims provisional application No. 60/329,130 filed Oct. 15, 2001.

BACKGROUND OF THE INVENTION

1. Field of the Invention

This invention relates to the exercise art and more particularly to an improved bar bell or dumbbell arrangement for use in exercising, body building and the like.

2. Description of the Prior Art

In many exercises and body building activities the person so exercising or body building utilizes exercise weights in various forms and structures. Among the more common of these exercise weights are bar bell and the dumbbell types of weights. In utilizing such weights, it is often desired to vary the weight being utilized. That is, different exercises require different weights for effective exercising of then particular body part. Different people require different weights for the same exercise depending on the muscular strength of the individual. Over time, as a person develops greater muscular strength, or alternatively, if the muscle strength decreases, the same person may require more or less weight for the same exercise. In many prior art applications supplying the various weights has required a large number of fixed weight dumbbells and/or bar bells. For example, such weights have been provided in increments of 2.5, 5, 10 and other weight increments. Thus, there have often been provided a plurality of the bar bells and dumbbells each having a specified weight and the space requirements for the racks to hold such fixed weight bar bells and dumbbells becomes quite large.

The barbells and dumbbells are generally comprised of a handle or bar and the weight plates or discs are attached either permanently by, for example a cap screw, or the like, to each of the ends of the handle or bar or the weight discs or plates are slipped over the ends of the bar and removably retained thereon by a collar a spring clip or other retention device so as to prevent the weight plates or discs from inadvertently sliding from the bar or handle. Such an arrangement did limit the space required for providing a plurality of variously weighted bar bells or dumbbells by requiring only one bar or handle but the devices used for retention of the weight plates or discs on the bar or handle were often difficult to use and often easy to misplace.

As noted above, in some barbells and dumbbells the weight plates or discs have generally been attached by cap screws or the like to the handle or bar. One variation of such a bar bell or dumbbell to allow increasing the weight thereof easily and quickly is shown in my prior U.S. Pat. No. 5,628,716 which provides the ability to use only one bar bell or dumbbell to which a weight plate or disc is attached but still allows for increasing the weight thereof. This is achieved in an arrangement of an exercise weight such as a bar bell or dumbbell which is provided with an externally threaded boss on each end of the bar bell extending outwardly from the weight plate or disc. Various add on weight plates or discs are provided with a central internally threaded aperture matching the external threads on the boss. This allows a variety of weight discs to be removably attached to the bar bell bar or handle by mounting the weight plates or discs on the boss. The attachment is secure without danger of the weight plates or discs sliding off the bar or handle during use. This arrangement is particularly adaptable to bar bells since in many bar bells the first weight plates or discs on each end of the bar or handle are retained on the handle by a cap screw extending through the fixed weight plate or disc and threading into an internally threaded aperture in the ends of the handle or bar. By adding the threaded boss on the exterior of the first weights, a selected additional weight disc may be easily added to each end of the bar bell. This structure is also applicable to dumbbells of the type wherein the weight plates or discs are retained on the handle by a cap screw in a manner similar to the bar bell. A plurality of the weight plates or discs in various weight increments may be provided and only a single bar bell or two dumbbells (since dumbbells are often utilized in many exercises by having one in each hand of the user) are needed to have a variable weight device for such exercising or body building.

In some dumbbells, particularly the type of dumbbells which have a hexagon shaped weight at each end of the handles, the hexagon or hex weights are permanently attached by, for example, welding, brazing, or the like, to the handle and the cap screw and the internally threaded aperture in the handle are not present. The structure of the above mentioned patent is not readily utilized in the absence of the central, internally threaded aperture in the handle of the existing bar bell or dumbbell. Similarly, some bar bells have the first weight discs permanently secured by, for example, welding brazing or the like, to the bar or handle without the provision of a cap screw for retention thereof. The structure of the above mentioned patent is not readily adapted to such bar bells.

In one prior art device of a hex dumbbell, sold under the name "Adjusta Hex" and sold by Bollinger, Inc., there is provided a centrally drilled and threaded aperture in each end of the permanently secured hexagonal weight in a hex dumbbell. A plurality of variously weighted hex shaped weight discs are provided and each of the hex weight discs has an externally extending threaded boss which threadingly engages the central threaded aperture in the ends of the dumbbell. Such an arrangement has not proven to be completely satisfactory since having an external threaded boss on each weight hex disc makes the hex discs difficult to store when not in use. Further, the protruding, exposed threaded boss may be subjected to inadvertent damage to the threads if the hex discs are dropped, mis-handled or the like. Such damage to the threads could render the particular damaged hex weight unusable.

Thus, there has long been a need for a bar bell or dumbbell of the type having a permanently affixed weight on each end of the bar or handle in which add on weights may be easily and quickly added and removed to vary the weight of the device.

Accordingly, it is an object of the present invention to provide an improved exercise device.

It is another object of the present invention to provide an improved bar bell or dumbbell exercise device.

It is yet another object of the present invention to provide an improved bar bell or dumbbell exercise device of the type wherein a first weight is permanently secured to the end of the bar or handle with the ability to accept additional add on weight plates or discs thereby increasing then overall weight of the bar bell or dumbbell.

SUMMARY OF THE INVENTION

The above and other objects of the present invention are achieved, according to a preferred embodiment thereof, by providing a bar bell or dumbbell of the type having a first fixed weight disc or plate permanently secured on at least one end of the bar or handle with a threaded aperture preferably aligned along the axis of the bar or handle and extending at least into the permanently attached weight plate or disc. The threaded aperture may also extend into the bar or handle depending in the thickness of the permanently attached weight plate or disc.

A collar or boss is provided having a projecting first end portion which is externally threaded and is adapted to threadingly engage the threaded aperture in the bar bell or dumbbell. A second end portion of the collar has a diameter preferably greater than the first end and the second end portion is also externally threaded. Structure for rotating the collar are provided at the second end and such provisions may be for accepting a driver therein such as a blade screw driver, a Phillips driver, an Allen wrench, a torque wrench or the like. The first end portion of the collar may be a separate portion that is permanently secured to the second end portion by, for example, welding, brazing or the like. Alternatively, the first and second end portions may be unitarily machined from appropriate bar stock.

The first end portion of the collar is inserted into the threaded aperture in the bar bell or dumbbell and tightened therein, preferably until the second end portion of the collar abuts the fixed weight plate or disc.

A plurality of add on weight plates or discs are provided in various weight increments such as 2.5 pounds, 5 pounds, 10 pounds, 15 pounds, 20 pounds or other weight increments. The add on weight plates or discs may be circular, hexagonal or any other desired shape. Each of the add on weight plates or discs is provided with a central, axially disposed bore or aperture extending all or part of the way therethrough. The aperture in the weight plate or disc is internally threaded to match the threads on the second end of the collar. When it is desired to add weight to the bar bell or dumbbell, the desired add on weight plate or disc is selected and threaded onto the second end portion of the collar, thus providing the one bar or handle with the ability to have the weight thereof increased to any extent desired.

A bore or aperture may be provided in each of the add on weight plates or discs in regions spaced from the central bore to allow the add on weight plates or discs to be hung on a support when not in use.

When the present invention is utilized in applications utilizing the invention of my above mentioned patent, the external threads of the collar may be the same as the external threads on the structure of my prior invention so that the same add on weight plates or discs may be conveniently utilized in both applications.

BRIEF DESCRIPTION OF THE DRAWINGS

The above and other embodiments of the present invention may be more fully understood from the following detailed description taken together with the accompanying drawing in which similar reference characters are used for similar elements throughout and in which.

DESCRIPTION OF THE PREFERRED EMBODIMENTS

Figure 1:
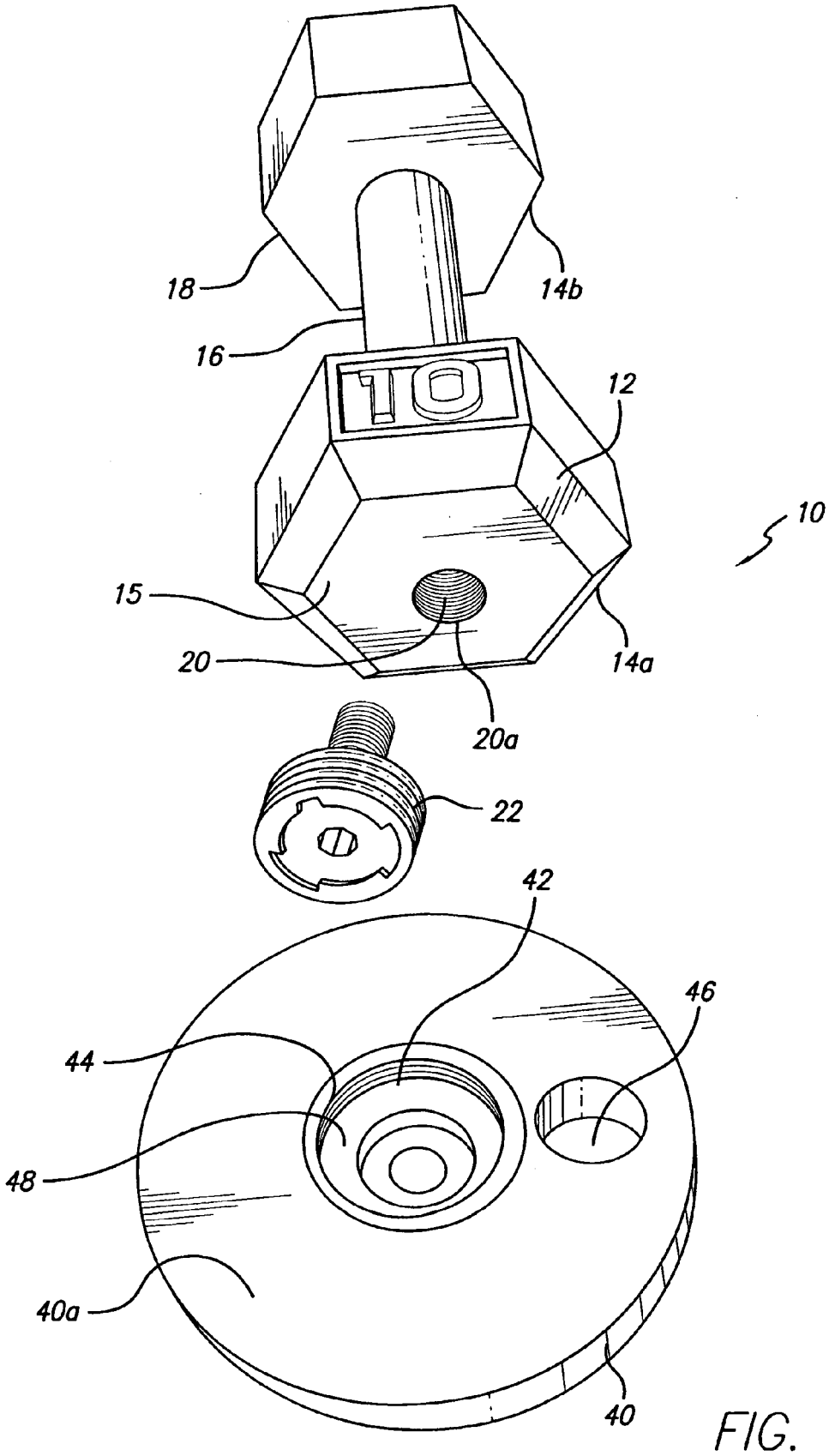
FIG. 1 is an exploded view of the present invention showing the main components thereof in a separated position.

In the following description of the present invention it is illustrated for use with a hex dumbbell to explain the principles and the advantages thereof. However, the present invention is not so limited and may be utilized on any bar bell or dumbbell regardless of the precise configuration of the weight plates or discs or size of the bar or handle.

Referring now to the drawing, there is illustrated an embodiment generally designated 10 of the present invention in an exploded or unassembled condition. The embodiment 10 is comprised of a hex dumbbell 12 of the type having a pair of hexagonally shaped weights 14*a* and 14*b*, one at each end of the bar or handle 16. The hexagonal or hex weights 14*a* and 14*b* are permanently secured to the handle 16 by welding, brazing or the like as indicated generally at 18. While the particular hex weights 14*a* and 14*b* are illustrated as providing a 10 pound weight dumbbell, the weight thereof may be any desired weight.

An aperture 20 is proved at each end of the dumbbell 12 and is preferably aligned along the axis of the bar or handle 16. The apertures 20 extend into the weights 14*a* and 14*b* and, depending on the thickness thereof, may also extend into the bar or handle 12. The apertures 20 are provided with internal threads as indicated at 20*a*.

Figures 2A, 2B, 2C:
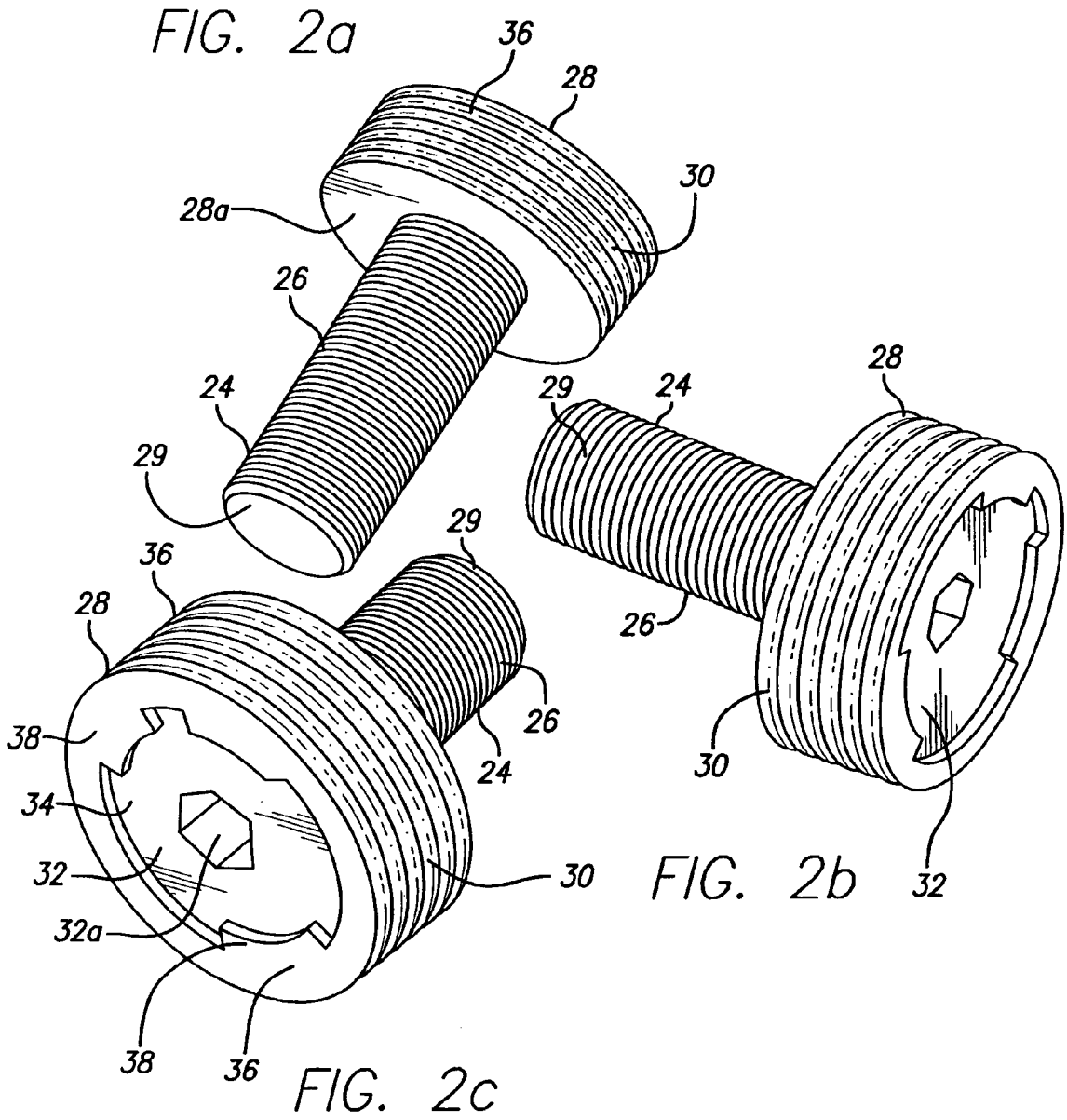
FIGS. 2*a*, 2*b* and 2*c* illustrate a collar useful in the present invention.

A collar 22 is provided and the collar 22 is illustrated in greater detail in FIGS. 2*a*, 2*b* and 2*c*. The collar 22 has a first end portion 24 extending outwardly and the first end portion 24 is provided with external threads 26 that match the threads 20*a* in aperture 20 to provide for threading engagement therebetween. The collar 20 is also provided with a second end portion 28 which has a diameter greater than the diameter of the first end portion 24. The second end portion 28 is provided with external threads 30. In the embodiment 10 as illustrated on FIGS. 2*a*, 2*b* and 2*c*, the first end portion 24 is comprised of a cap screw 29 having the headed portion 34 as well as the first end portion of the collar 24. The headed portion 34 has an Allen head aperture 32*a* therein to allow tightening of the collar 24 into the aperture 20. A torroidal member 36 is welded, as indicated at 38, to the headed portion 34 of the cap screw 29 to provided the larger diameter second end portion 28. In other embodiments of the present invention, the collar may be machined from a unitary rod rather than being composed of two separate portions. Further, the Allen head aperture 32 may be replaced by any desired type of aperture to fit, for example, a blade type driver, a torque type driver, or any other selected shape that allows for the tightening of the collar into the dumbbell 12. In other embodiments of the present invention, the diameter of the second end portion of the collar may be smaller than the diameter of the first end portion of the collar.

Figure 3:
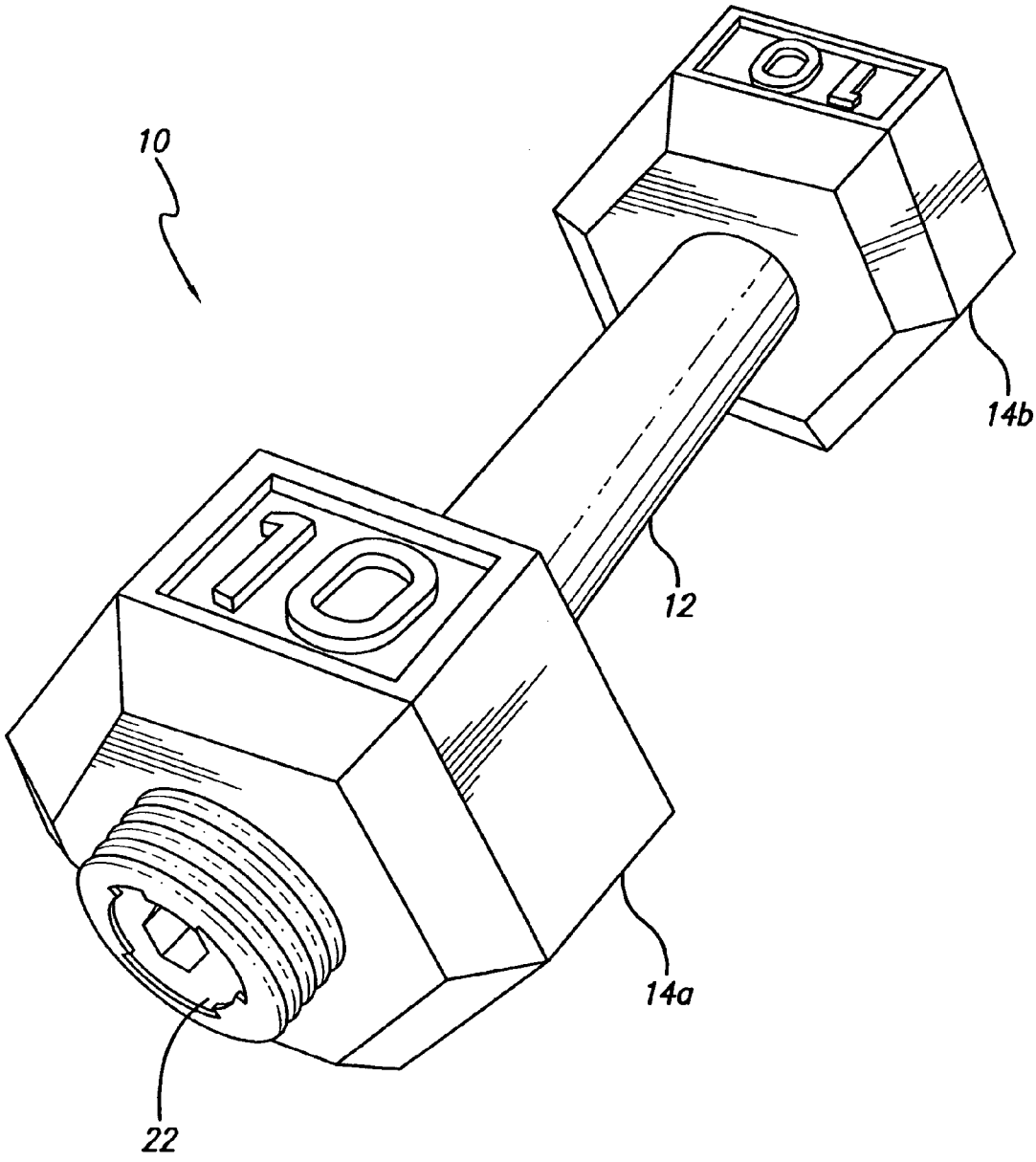
FIG. 3 illustrates a hex dumbbell with the collar installed therein.

FIG. 3 illustrates the embodiment 10 with the collar 22 installed on the dumbbell 12 and tightened so that the inner face 28*a* of the second end portion 28 (FIG. 2*a*) firmly abuts the outer face 15 of the hex weight 14*a* or 14*b*.

According to the principals of the present invention, a plurality of various weight plates or discs 40 (FIG. 1) are provided for attachment to the dumbbell 12. As shown on FIG. 1, the add on plates or discs 40 are provided with a central aperture 42 which, in preferred embodiments of the present invention does not extend through the plate or disc 40. The plate or disc 40 may be the same as the plate or disc describe in my U.S. Pat. No. 5,628,716. The shape of the add on weight plate or disc 40 may circular, as shown, or any other desired geometric configuration. The add on weights or plates 40 are provided in a plurality of weights. The central aperture 42 is provided with internal threads 44 that match the external threads 30 on the second end portion 28 of the collar 22. A bore 46 is provided between the periphery 48 of the add on weight or disc 40 and the central aperture 42 and preferably extends through the add on weight or disc 40. The bore 46 may be utilized in storing the add on weight or disc 40 when not installed on a bar bell or dumbbell.

Figure 4:
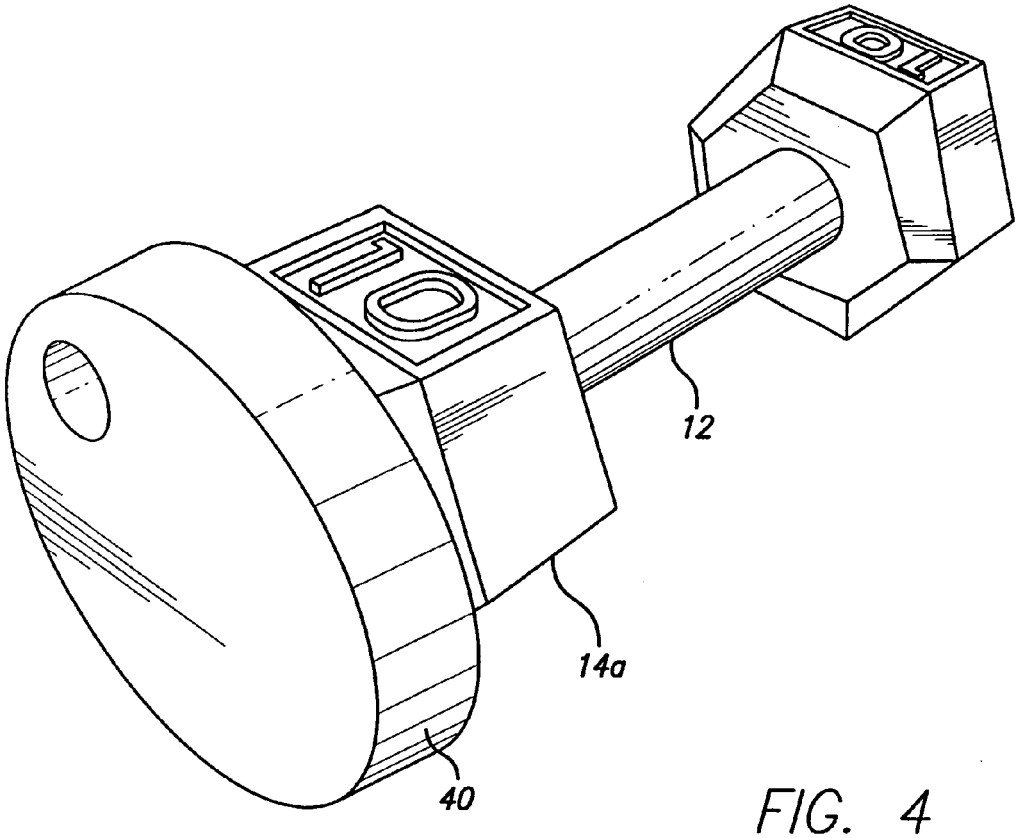
FIG. 4 illustrates a hex dumbbell with an add on plate coupled thereto on one end.

FIG. 4 illustrates the assembly of the add on weight or disc 40 on the weight 14*a* of the dumbbell 12. Preferably, the inner face 40*a* of the add on plate or disc 40 abuts against the outer face 15 of the weight 14*a* to provide a secure mounting. A washer, such as lock washer 48 may be provided in the aperture 42 to help to removably secure the add on weight plate or disc 40 when installed on the dumbbell 12.

Figure 5:
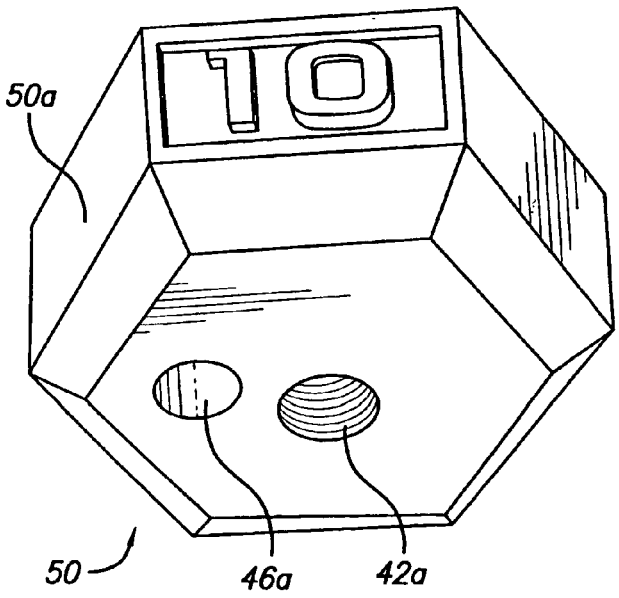
FIG. 5 illustrates a hexagonal add on plate useful in the practice of the present invention; and, FIG. 6 illustrates a weight support stand useful in the practice of the present invention.

As shown on FIG. 1, the add on plate or disc 40 is illustrated as circular in form as this is the type of plate or disc illustrated in my U.S. Pat. No. 5,628,716. However, for the hex dumbbells of the present invention, or any hex bar bells, it may be desirable to have the add on plate or disc in hexagonal form. FIG. 5 illustrates a hexagonal add on plate or disc generally designated 50. The hexagonal add on plate or disc 50 may be similar to the fixed hex weight 14*a* and 14*b* described above. The hex add on plate or disc 50 has a central threaded aperture 42*a* which may be similar to the aperture 42 of add on plate or disc 40 and may be provided with a lock washer (not shown) in a manner similar to that described above. The threaded aperture 42*a* is adapted to threadingly engage the external threads 30 of the collar 22 in a manner similar to the attachment of the add on plate or disc 40 to the collar 22. In some applications the hexagonal external peripheral surface 50*a* of the add on plate or disc 50 may provide a sufficient configuration for grasping during the insertion or removal of the add on plate or disc 50. However, in some applications it may be desirable to provide a bore 46*a*, which may be similar to the bore 46 of add on plate or disc 40, to allow for convenient rotation during installation or removal and/or for convenient storage. The bore 46 of plate or disc 40 and the bore 46*a* of hex shaped add on plate or disc 50 may if desired, extend through the add on plate or disc 50 or may extend only partially therethrough.

If desired, the threads of the aperture 42*a* may be indexed to the threads 30 of the collar 22 so that the hex periphery 50*a* of the add on plate or disc 50 lines up with the hex periphery of the fixed weights 14*a* and 14*b*.

Figure 6:
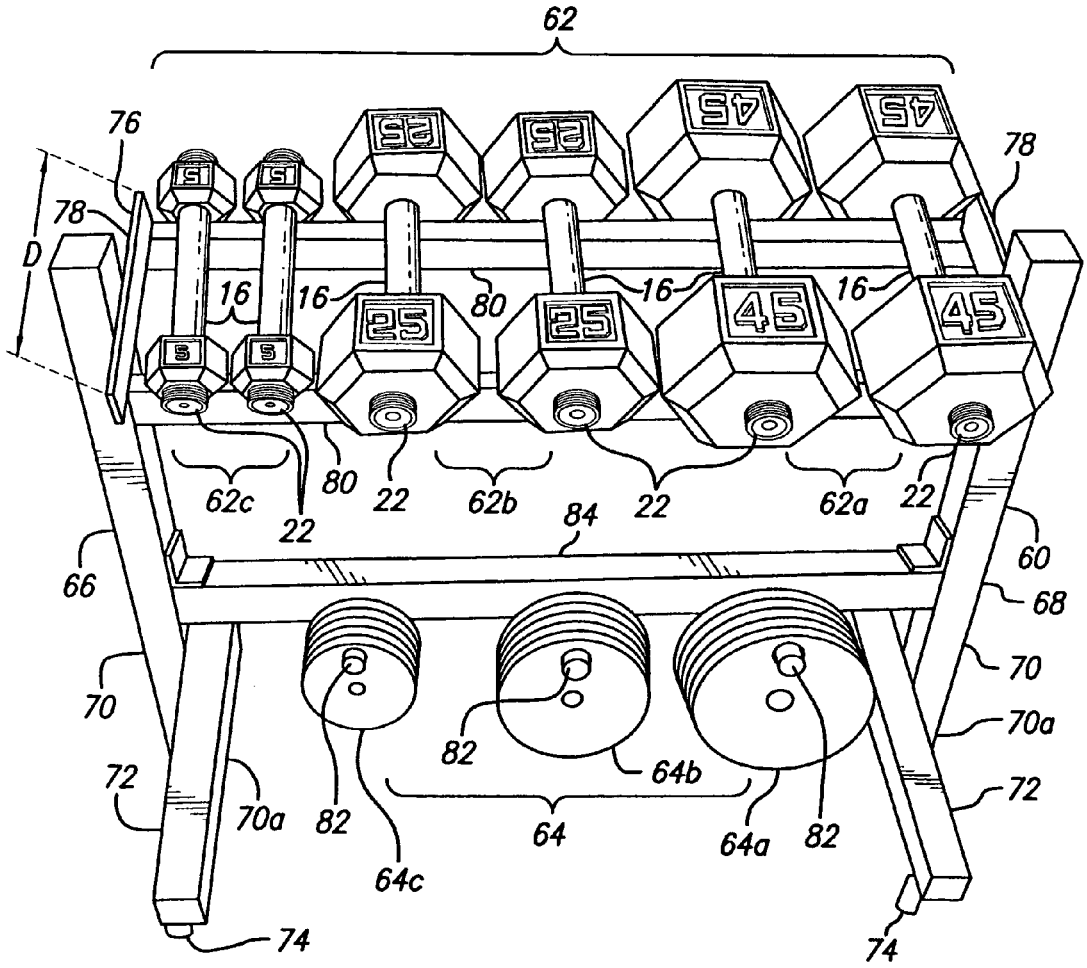

The present invention also provides a convenient stand for supporting the dumbbells or bar bells according to the principals of the present invention a well as the add on plates or discs either cylindrical or hexagonal. FIG. 6 illustrates a stand 60 on which a plurality of hex dumbbells 62 of varying weights and a plurality of cylindrical add on discs or plates 64 are supported when not in use. The stand 60 has a pair of spaced apart end supports 66 and 68 which are similar to each other and each have a vertical member 70 to which is attached, by, for example, welding, a base horizontal member 72 at the lower ends 70*a* of vertical members 70. Each end of the horizontal members 72 is provided with a caster type device 74 to allow convenient movement of the stand 60.

A weight support rack 76 is coupled to each of the vertical supports 70 in regions adjacent the upper ends 70*b* thereof for supporting the hex dumbbells 62 thereon. The weight support rack 76 is provided with a pair of spaced apart end members 78 coupled to the vertical members 70 by, for example, welding. A pair of spaced apart flange members 80, which may, for example, be angle flanges, are coupled to spaced apart end members in a preselected distance indicated by the letter "D". Pins 82 are coupled to a lower transverse member 84 which is coupled to the vertical members 70 in regions intermediate the weight support rack 76 and the base horizontal members 72 for supporting the add on weights or discs 64 by the apertures 46 provided therein as described above.

As shown on FIG. 6, the hex dumbbells 62 are arranged in matched pairs such as a pair 62*a* of 45 pound dumbbells, a pair 62*b* of 25 pound dumbbells and a pair 62*c* of 5 pound dumbbells. For purposes of illustration, each of the hex dumbbells is shown in FIG. 6 as having the collars 22 installed thereon. As such, each of the hex dumbbells 62 is ready to receive an add on plate or disc such as the add on weight plates or discs 64 which may be similar to the add on plates or discs 40 described above and which are conveniently mounted on the stand 60 according to the weight thereof as indicated by the selected matching weights at 64*a*, 64*b* and 64*c*. Alternatively, the add on plates or discs 64 may be in the form of the hex plate or disc 50 described above. Whatever shape the add on plates or discs may be secured to the collars 22 as desired in the manner as described above. If the add on weight plates or discs are in the form of a hex as shown in FIG. 5 above, the threading of the collar 22 to the hex dumbbells and the threading of the add on weight plates or discs 64 may be indexed to provide alignment of the hex weight of the dumbbell with the hex add on weight plate or disc. The hex dumbbells 62 have handles 16 as described above and in preferred embodiments of the present invention the axial length of the handles 16 is the same in all of the dumbbells 62*a*, 62*b* and 62*c* so that inside surface of the hex weights on each dumbbell is the distance "D" so that all the dumbbells, regardless of weight, fit appropriately on the weight support rack 76 by engagement with the upstanding portion of the flanges 80.

In use, it is preferred that the collars 22 only be installed on the hex weights 62 when it is desired to utilize an add on weight plate or disc 64 so that the threads on the collars are not damaged or cause damage when the dumbbells are used without any add on wight plate or disc.

This concludes the description of the present invention. The advantages of the present invention are understood from the above description and the accompanying drawing. Thus, the present invention may be utilized in existing exercise weight dumbbells or bar bells where the first weight on the handle thereof is fixed by drilling and tapping a mounting hole in the ends of the fixed weights along the axis of the handle so that a collar as described herein may be threaded therein. Additionally, the provision of a threaded aperture in the ends of a bar bell or dumbbell along the axis of the handle thereof can easily be incorporated into the existing manufacturing process of such dumbbells and bar bells with minimum additional cost by the additional step of machining the threaded aperture leaving the existing manufacturing process as currently practiced. The threaded aperture may extend into the weight or through the weight into the handle depending on the axial thickness of the permanently attached weight.

It is apparent that many variations and adaptations may be made in the form of the components of the structure and the arrangements of the parts of the invention without departing from the true scope and spirit of the invention. The embodiments shown on the drawing and as above described illustrate the best mode known to the inventor of carrying out the invention. The appended claims are intended to cover all variations and adaptations falling within the scope and spirit of the invention.

What is claimed is:

1. An adjustable weight exercise device of the type having a weight permanently attached to the end of a handle comprising, in combination:

a cylindrical handle having an axis and a predetermined axial length and a first end and a second end;

a first weight permanently attached to said first end of said handle and a second weight permanently attached to said second end of said handle, and each of said first weight and said second weight having a first preselected geometric peripheral configuration and a predetermined weight and having an external surface and an internal surface, said internal surfaces of said first and said second weights separated by said predetermined axial length of said handle;

first walls defining a first threaded aperture extending into said first weight and second walls defining a second threaded aperture extending into said second weight, said first threaded aperture and said second threaded aperture co-axial with said axis of said handle, and each of said first threaded aperture and said second threaded aperture having a preselected axial depth;

a collar having a projecting first end portion having a first diameter and having first external threads thereon and said first external threads for threadingly engaging said first threaded aperture and said second threaded aperture, and a projecting second end portion having a second diameter and having second external threads thereon, and said second diameter of said second end portion different from said first diameter of said first end portion, and said second end portion having tool accepting walls thereon for accepting a tool for rotating said collar to facilitate said threading engagement of said first end portion into said first and second apertures;

said second end portion having an external end surface and an internal end surface, said internal end surface adjacent said first end portion, and said internal end surface of said second end portion abutting said external surfaces of said first and said second weights for the condition of said collar inserted into said first weight and said second weight;

a plurality of add on weight plates having preselected weights and each of said plurality of add on weights having a second predetermined external geometric peripheral configuration and having central walls defining a central axially disposed aperture therein having internal threads for threading engagement with said threads on said second end portion of said collar; and at least some of said plurality of add on weights has walls defining a tool access aperture extending therein for allowing tool engagement with said tool accepting walls of said collar.

2. The arrangement defined in claim 1 wherein:

said second predetermined external geometric peripheral configuration of said plurality of add on weight plates is the same geometric peripheral configuration as said first preselected geometric peripheral configuration of at least one of said first weight and said second weight.

3. The arrangement defined in claim 1 wherein:

at least some of said plurality of add on weights have walls defining a bore therethrough in regions between said central threaded aperture and said peripheral surface.

4. The arrangement defined in claim 1 wherein:

said second predetermined external geometric peripheral configuration of at least some of said plurality of add on weights is the same as said first preselected geometric peripheral configuration of said first and said second weights;

said threads in said first threaded aperture and in said second threaded aperture of said first weight and said second weight are indexed with said first external threads and said second external threads of said collar and said internal threads of said plurality of add on weight plates whereby said second predetermined external geometric peripheral configuration of said add on weight plates are alignable with said first preselected geometric peripheral configuration of said first weight and said second weight.

5. The arrangement defined in claim 1 wherein:

said second diameter of said second end portion of said collar is larger than said first diameter of said first end portion thereof.

6. The arrangement defined in claim 1 wherein:

said second predetermined external geometric peripheral configuration of said add on weight plates is different from said first preselected geometric peripheral configuration of said first weight and said second weight.

7. The arrangement defined in claim 1 and further comprising:

a support stand comprising:

a pair of spaced apart vertical members;

base horizontal members having casters thereon coupled to said vertical members;

a weight support rack coupled to said vertical members in spaced apart relationship to said base horizontal members and having a pair of spaced apart flange members;

a transverse member coupled to said vertical members intermediate said weight support rack, a plurality of pins coupled to said transverse member and extending therefrom;

whereby said handle with said first weight and said second weight may be supported on said weight support rack and said plurality of add on weigh plates may be supported on said pins.

8. The arrangement defined in claim 7 wherein:

said plurality of add on weights have walls defining a bore therethrough in regions between said central threaded aperture and said peripheral surface thereof, whereby said pins of said support stand may be inserted into said bore of said plurality of add on weight plates.

9. The arrangement defined in claim 8 wherein:

said first preselected geometric peripheral configuration of said first and said second weights is hexagonal;

said flange members have upstanding flange portions and said flange members are spaced apart by said predetermined axial length of said handle, whereby said internal surfaces of said first weight and said second weight are abuttable against said upstanding flange portions of said flange members.

10. The arrangement defined in claim 9 wherein:

said second predetermined external geometric peripheral configuration of said plurality of add on weight plates is the same geometric configuration as said first preselected geometric peripheral configuration of at least one of said first weight and said second weight.

11. The arrangement defined in claim 10 wherein:

said second diameter of said second end portion of said collar is larger than said first diameter of said first end portion thereof.

12. The arrangement defined in claim 5 and further comprising:

a support stand comprising a pair of spaced apart vertical members;

base horizontal members having casters thereon coupled to said vertical members;

a weight support rack coupled to said vertical members in spaced apart relationship to said base horizontal members and having a pair of spaced apart flange members;

a transverse member coupled to said vertical members intermediate said weight support rack, a plurality of pins coupled to said transverse member and extending therefrom.

13. The arrangement defined in claim 7 wherein:

said threads in said first threaded aperture and in said second threaded aperture of said first weight and said second weight are indexed with said first external threads and said second external threads of said collar and said internal threads of said plurality of add on weight plates whereby said second predetermined external geometric peripheral configuration of said add on weight plates are alignable with said first preselected geometric peripheral configuration of said first weight and said second weight.

14. The arrangement defined in claim 13 wherein:

said second predetermined external geometric peripheral configuration of at least some of said plurality of add on weights is the same as said first preselected geometric peripheral configuration of said first and said second weights.

15. The arrangement defined in claim 1 wherein:

said second predetermined external geometric peripheral configuration of each of said plurality of add on weights is the same as said first preselected geometric peripheral configuration of said first and said second weights.

* * * * *